US011351414B2

(12) United States Patent
Johnston

(10) Patent No.: US 11,351,414 B2
(45) **Date of Patent: *Jun. 7, 2022**

(54) USER LIFT EXERCISE APPARATUS

(71) Applicant: Gary Lawrence Johnston, Cowarts, AL (US)

(72) Inventor: Gary Lawrence Johnston, Cowarts, AL (US)

( * ) Notice: Subject to any disclaimer, the term of this patent is extended or adjusted under 35 U.S.C. 154(b) by 129 days.

This patent is subject to a terminal disclaimer.

(21) Appl. No.: 16/792,269

(22) Filed: Feb. 16, 2020

(65) Prior Publication Data

US 2020/0254304 A1 Aug. 13, 2020

Related U.S. Application Data

(63) Continuation of application No. 15/619,235, filed on Jun. 9, 2017, now Pat. No. 10,561,897.

(51) Int. Cl.

| | |
|---|---|
| ***A63B 22/20*** | (2006.01) |
| ***A63B 23/04*** | (2006.01) |
| ***A63B 21/068*** | (2006.01) |
| ***A63B 21/06*** | (2006.01) |
| ***A63B 21/00*** | (2006.01) |
| ***A63B 23/12*** | (2006.01) |
| ***A63B 1/00*** | (2006.01) |

(52) U.S. Cl.

CPC ..... *A63B 22/205* (2013.01); *A63B 1/00* (2013.01); *A63B 21/068* (2013.01); *A63B 21/0615* (2013.01); *A63B 21/4035* (2015.10); *A63B 21/4039* (2015.10); *A63B 21/4047* (2015.10); *A63B 23/04* (2013.01); *A63B 23/12* (2013.01); *A63B 2225/09* (2013.01)

(58) Field of Classification Search

CPC ..... A63B 21/4045; A63B 21/205

See application file for complete search history.

(56) References Cited

U.S. PATENT DOCUMENTS

| | | | | |
|---|---|---|---|---|
| 5,527,249 | A * | 6/1996 | Harris | A63B 21/068 482/57 |
| 5,580,340 | A * | 12/1996 | Yu | A63B 21/055 482/72 |
| 5,997,446 | A * | 12/1999 | Stearns | A63B 21/00072 482/56 |
| 6,387,024 | B1 * | 5/2002 | Monti | A63B 21/4035 482/142 |
| 7,331,913 | B2 * | 2/2008 | Forcillo | A63B 23/0222 482/142 |

(Continued)

*Primary Examiner* — Joshua T Kennedy

(57) ABSTRACT

A User Lift Exercise Apparatus is provided which has a base frame member with a seat support member coupled thereon which moves in the upward and downward directions. The apparatus also has a user engagement member which pivotally mounts to the front of the base frame member. The back portion of the user engagement member is coupled to the seat support member. The user engages the front portion of the user engagement member with their thighs and pivots this front portion in the downward direction, which produces upward movement in the back portion and thus in the seat support member. The opposite movement is also true. This allows the user to perform exercise routines on the lower body muscles areas while in a relatively seated position. Handle members may also be part of the apparatus.

18 Claims, 9 Drawing Sheets

(56) References Cited

U.S. PATENT DOCUMENTS

| | | | | |
|---|---|---|---|---|
| 7,806,815 | B2 * | 10/2010 | Fernandez | A63B 21/4047 482/140 |
| 7,938,760 | B1 * | 5/2011 | Webber | A63B 23/1263 482/97 |
| 8,007,414 | B2 * | 8/2011 | Riney | A63B 21/4035 482/95 |
| 8,317,665 | B2 * | 11/2012 | Webber | A63B 21/4043 482/97 |
| 9,717,942 | B2 * | 8/2017 | Bastyr | A63B 21/00072 |
| 2008/0113850 | A1 * | 5/2008 | Webber | A63B 21/4047 482/96 |
| 2008/0248929 | A1 * | 10/2008 | Webber | A63B 21/154 482/96 |
| 2008/0254951 | A1 * | 10/2008 | Chu | A63B 23/03525 482/96 |
| 2013/0324374 | A1 * | 12/2013 | Ellis | A63B 21/1609 482/97 |
| 2014/0121070 | A1 * | 5/2014 | Ellis | A63B 22/205 482/96 |

* cited by examiner

USER LIFT EXERCISE APPARATUS

BACKGROUND OF THE INVENTION

This invention relates to a User Lift Exercise Apparatus which has a base frame member with a seat support member coupled thereon so that the seat moves upward and downward in a controlled manner. The apparatus also has a user engagement member which pivotally mounts to the front of the base frame member. The user engages the front portion of the user engagement member with their thighs and pivots the user engagement member in the downward direction. The back portion of the user engagement member will thus move upward, and it is coupled to the seat support member so that this upward movement produces upward movement in the seat support member. Therefore the downward pivoting motion of the front of the user engagement member will produce upward motion in the seat support member, and vice versa. This allows the user to perform exercise routines on the lower body muscle areas. These routines are performed while in a relatively seated position. Handle members may also be a part of the apparatus to assist the user in reducing the net weight of the user upon the seat support member, and thus create an exercise routine for the upper body muscle areas. A back support member may also be part of the apparatus for comfort. The apparatus may thus be used for both upper and lower body exercise routines to allow an overall body workout.

SUMMARY AND OBJECTS OF THE INVENTION

It is the object of this invention to provide a User Lift Exercise Apparatus which may provide the user an efficient and inexpensive means for exercising both the upper and lower body muscle groups. The main purpose of this application is to demonstrate an apparatus which performs the stated function, and to demonstrate the many options and configurations this apparatus may take on.

Briefly stated, the apparatus that forms the basis of the present invention comprises a Base Frame Member, a Seat Support Member, and a User Engagement Member. The Seat Support Member is mounted upon the Base Frame Member so that it moves in the generally upward and downward directions, while the User Engagement Member is pivotally supported by the Base Frame Member. The User Engagement Member and the Seat Support Member are operatively connected together such that the downward motion in the front part of the User Engagement Member produces upward motion in the seat support member, and vice versa.

The design of the apparatus is such that the user will position themselves in a generally seated position upon the seat support member, and engage the user engagement member with their thighs. As the user pushed downward upon the front part of the user engagement member, the back part of the user engagement member will move upward, since the user engagement member is pivotally mounted to the base frame member, and cause the seat support member to move upward. Similarly, downward movement of the seat support member will produce upward movement of the front of the user engagement member.

Also, an optional feature of the apparatus which makes the apparatus more flexible are handle members. The handle members may rigidly mount to the sides of the base frame member. As mentioned previously, the user will push downward upon the front of the leg engagement member with their thighs, which produces upward motion in the seat support member. The force exerted upward upon the user by the seat may be reduced by having the user push downward upon the handle members. Since the seat is moving upward, this produces an exercise routine commonly known as "dips" and will exercise the upper body muscle groups. The user may also pull upward upon the handle members while the seat is moving upward, producing resistance in the upward movement of the seat support member, thus producing resistance to the downward movement of the front part of the user engagement member. Thus the user is able to utilize their body weight and body strength for motion resistance.

Another optional feature of the apparatus may be a back support member for comfort. There may also be weight support members at both the front and back portions of the leg engagement member. Adding weights to the front part of the user engagement member will make the downward movement of the user engagement member easier, while adding weights to the back of the user engagement member will make the downward movement of the user engagement member more difficult. Depending upon the location, the weights will either increase or decrease the net resistance effect of the user body weight.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1C:
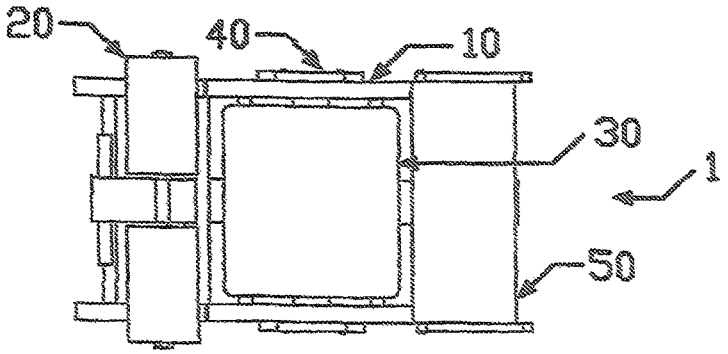
FIG. 1C is a top view of the User Lift Exercise Apparatus.
Figure 1A:
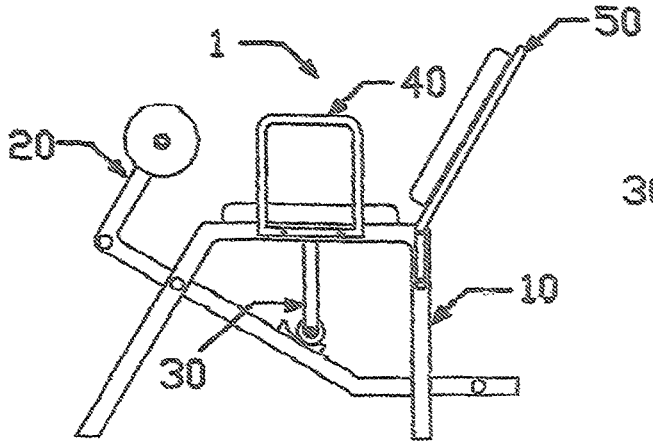
FIG. 1A is a side view of the User Lift Exercise Apparatus.
Figure 1B:
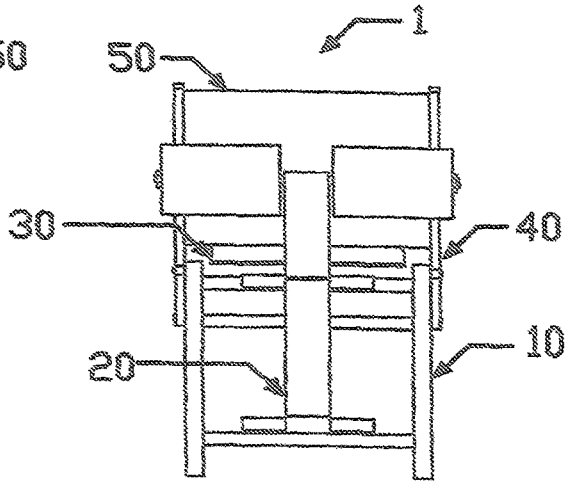
FIG. 1B is a front view of the User Lift Exercise Apparatus.

As best can be seen by references to the drawings, and in particular to FIGS. 1A-1C, the User Lift Exercise Apparatus that forms the basis of the present invention is designated generally by the reference numeral 1, and includes a Base Frame Member 10, a User Engagement Member 20, and a Seat Support Member 30. Optional components also shown are Handle Members 40 and a Back Support Member 50. The User Engagement Member 20 is pivotally mounted on the Base Frame Member 10, while the Seat Support Member 30 is coupled to the Base Frame Member 10 such that it moves in the upward and downward directions, in a controlled manner. Handle Members 40 may also be part of the apparatus to enable an upper body workout routine, while a Back Support Member 60 may be included for comfort.

Figure 2C:
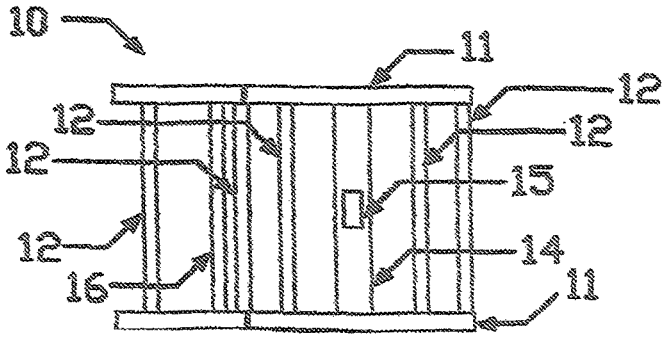
FIG. 2C is a top view of the Base Frame Member of the User Lift Exercise Apparatus.
Figure 2A:
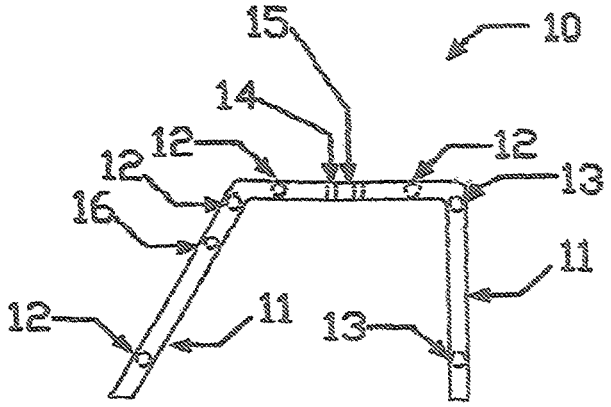
FIG. 2A is a side view of the Base Frame Member of the User Lift Exercise Apparatus.
Figure 2B:
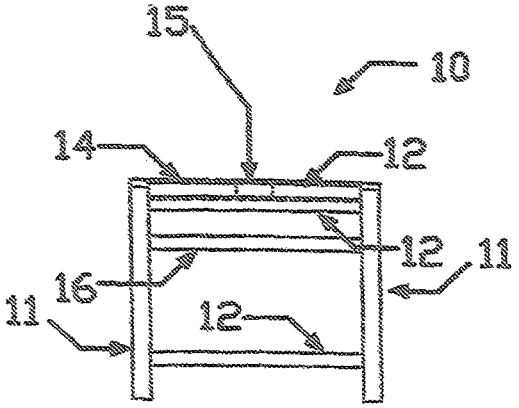
FIG. 2B is a front view of the Base Frame Member of the User Lift Exercise Apparatus.

As may be seen in FIGS. 2A-2C, the Base Frame Member 10 comprises Main Support Members 11, Cross Support members 12, Cross Limit Members 13, Frame Guide Member 14, Guide Member Opening 15, and Engagement Support Member 16. The Main Support Members 11 are located on each side of the apparatus, and are rigidly connected together by Cross Support Members 12 and Cross Limit Members 13. Cross Limit Members 13 are also utilized to limit the pivot motion of the User Engagement Member. Frame Guide Member 14 also rigidly connects the Main Support Members 11 and has a Guide Member Opening 15. Engagement Support Member 16 is supported on both ends by Main Support Members 11 and is used to pivotally mount the User Engagement Member.

Figure 3A:
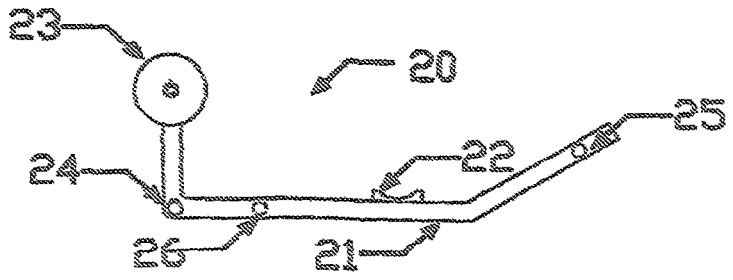
FIG. 3A is a side view of the User Engagement Member of the User Lift Exercise Apparatus.
Figure 3B:
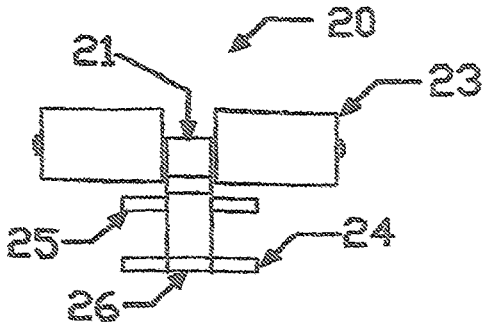
FIG. 3B is a front view of the User Engagement Member of the User Lift Exercise Apparatus.
Figure 3C:
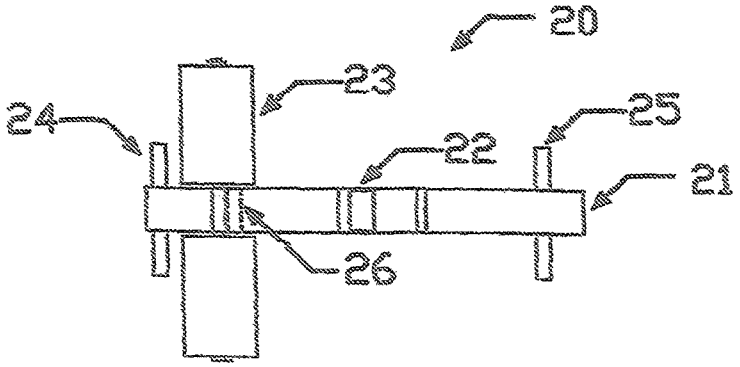
FIG. 3C is a top view of the User Engagement Member of the User Lift Exercise Apparatus.

As may be seen in FIGS. 3A-3C, the User Engagement Member 20 has a Main Engagement Support Member 21, which extends from the front to the back of the apparatus at it proximate center. The front portion of the Main Engagement Support Member 21 has a Thigh Engagement Member 23 mounted thereon, with an Engagement Coupling Member 22 mounted on the back portion. The Support Member Opening 26 is also located on the front portion of the Main Engagement Support Member 21 and is used to pivotally couple the Main Engagement Support Member 21 to the Engagement Support Member of the Base Frame Member. It may include some type of bearing to make the pivoting motion much smoother. The back portion of the Main Engagement Support Member 21 has an upward bend with respect to the front portion. Front Weight Support Members 24 and Back Weight Support Members 25 are optional and may be used to mount weight members to the respective front and back portions of the User Engagement Member 20.

Figure 4C:
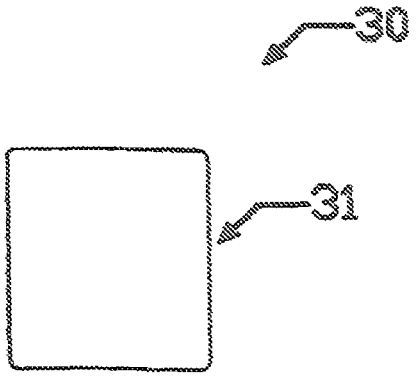
FIG. 4C is a top view of the Seat Support Member of the User Lift Exercise Apparatus.
Figure 4A:
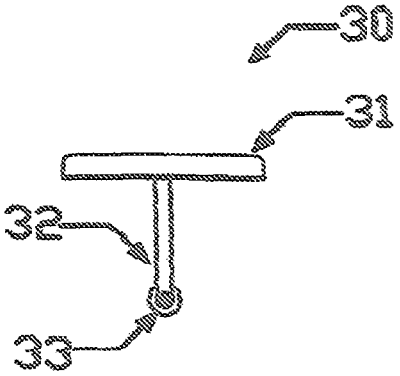
FIG. 4A is a side view of the Seat Support Member of the User Lift Exercise Apparatus.
Figure 4B:
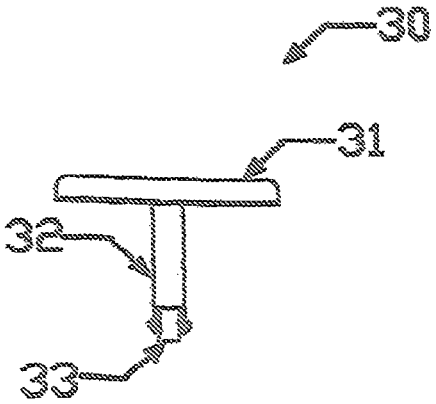
FIG. 4B is a front view of the Seat Support Member of the User Lift Exercise Apparatus.

FIGS. 4A-4C shows the Seat Support Member 30 of the User Lift Exercise Apparatus. The Seat Support Member 30 is comprised of a generally horizontal Main Seat Member 31, which is mounted upon a downwardly extending, elongated Seat Guide Member 32. At the bottom of Seat Guide Member 32 is a Seat Coupling Member 33, which operatively engages the Engagement Coupling Member of the User Engagement Member. Seat Guide Member 32 mounts through the Guide Member Opening of the Frame Guide Member of Base Frame Member.

Figure 5C:
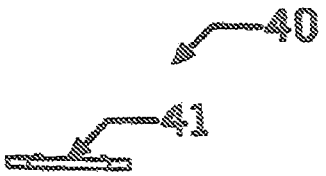
FIG. 5C is a top view of the Handle Member of the User Lift Exercise Apparatus.
Figure 5A:
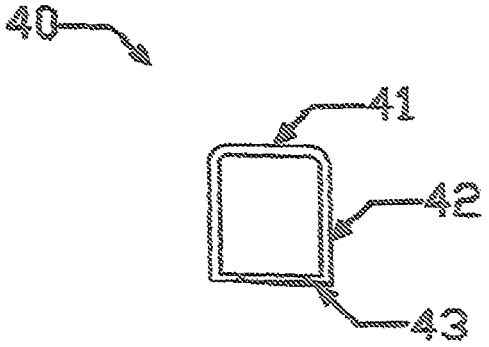
FIG. 5A is a side view of the Handle Member of the User Lift Exercise Apparatus.
Figure 5B:
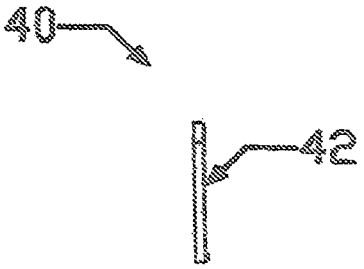
FIG. 5B is a front view of the Handle Member of the User Lift Exercise Apparatus.

FIGS. 5A-5C shows the Handle Member 40 which may also be part of the User Lift Exercise Apparatus. The Handle Member 40 is a basic handle member with a Hand Engagement Member 41 mounted at the top, with two Handle Support Members 42 located to the side, extending downward, and rigidly connecting both ends of the Hand Engagement Member 41. Rigidly connecting the bottoms of the Handle Support Members 42 is a Handle Attachment Member 43. It is used to mount the Handle Member 40 to the Base Frame Member using a common type of securing means such as a bolt assembly or screw. The Handle Members 40 may be utilized for an upper body workout routine.

Figure 6C:
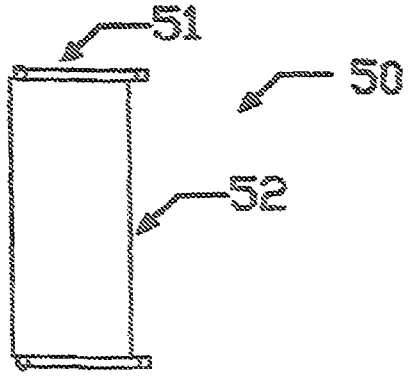
FIG. 6C is a top view of the Back Support Member of the User Lift Exercise Apparatus.
Figure 6A:
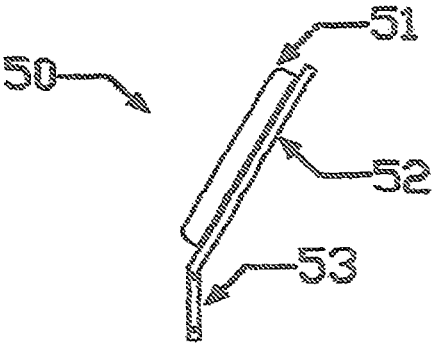
FIG. 6A is a side view of the Back Support Member of the User Lift Exercise Apparatus.
Figure 6B:
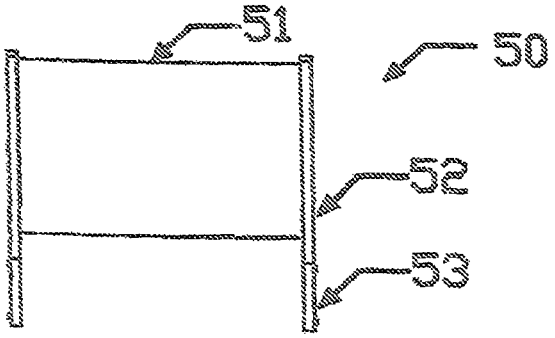
FIG. 6B is a front view of the Back Support Member of the User Lift Exercise Apparatus.

As may be seen in FIGS. 6A-6C, the User Lift Exercise Apparatus may also have a Back Support Member 50, which attaches to the rear of the Base Frame Member. It is used primarily for comfort purposes, and comprises a Back Rest Member 51 rigidly mounted to a Back Frame Member 52. A Back Support Attachment Member 53 is used to attach the Back Frame Member 52 to the Base Frame Member using a common type of securing means such as a bolt assembly or screw.

Figure 7A:
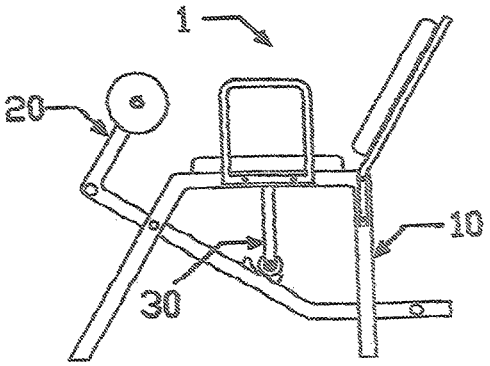
FIG. 7A is a side view of the User Lift Exercise Apparatus demonstrating one of its operating positions.

FIGS. 7A-7D demonstrates several operating positions of the User Lift Exercise Apparatus. FIG. 7A shows the apparatus in its normal state. The front portion of the User Engagement Member 20 is pivotally mounted to the Base Frame Member 10, along its Engagement Support Member, close to the middle of the apparatus, and at an angle. The Seat Support Member 30 is completely down and resting upon the Base Frame Member 10. At this point, the back portion of the User Engagement Member which has an upward bend, is resting upon the lower Cross Limit Member of the Base Frame Member 10. The back portion is also operatively connected to the Seat Support Member 30.

Figure 7B:
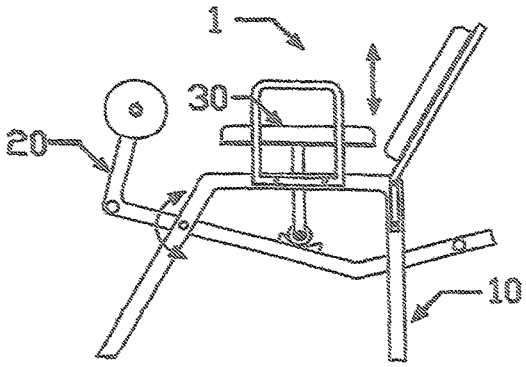
FIG. 7B is a side view of the User Lift Exercise Apparatus demonstrating another of its operating positions.
Figure 7C:
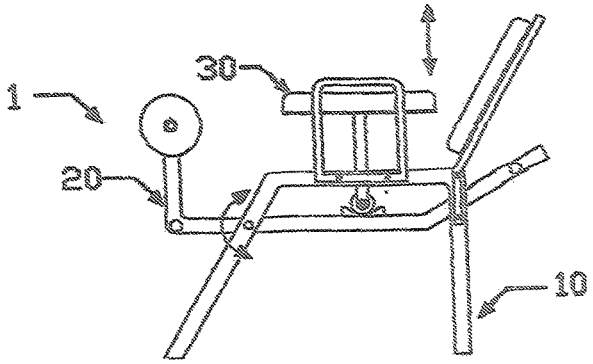
FIG. 7C is a side view of the User Lift Exercise Apparatus demonstrating another of its operating positions.
Figure 7D:
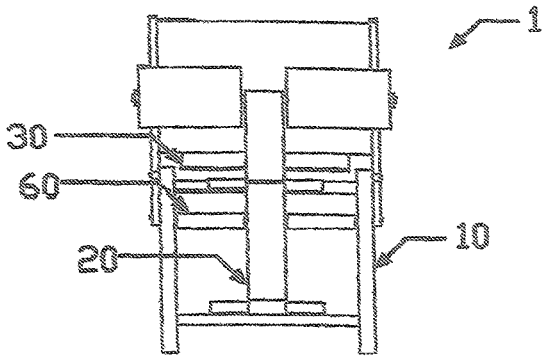
FIG. 7D is a front view of the User Lift Exercise Apparatus demonstrating sleeve members which may be utilized to keep the User Engagement Member in the center of the apparatus.

FIG. 7B shows an operating position of the User Lift Exercise Apparatus. After the user has begun pushing downward upon the Thigh Engagement Members of the User Engagement Member 20 with the thighs of their legs, the front portion of the User Engagement Member 20 pivots downward, causing the back portion of the User Engagement Member 20 to pivot upward. Since the Seat Support Member 30 is operatively connected by the Seat Coupling Member to the back portion through the Engagement Coupling Member of the User Engagement Member 20, the Main Seat Member of the Seat Support Member 30 will begin to move upward. The Seat Guide Member of the Seat Support Member will move upward through the Guide Member Opening of the Frame Guide Member of the Base Frame Structure 10 and guide the Main Seat Member upward. Guide Member Opening may comprise some type of bearing to make the motion smoother. As the user pushes further downward upon the Thigh Engagement Members, the User Engagement Member 20 and Seat Support Member 30 will reach their maximum allowable positions as shown in FIG. 7C. At this point, the back portion of the User Engagement Member 20 is in contact with the upper Cross Limit Member of the Base Frame Member 10, which prohibits the Leg Engagement Member from pivoting downward any further, and thus the Seat Support Member 30 from rising any further. FIG. 7D shows sleeve members 60 which have been placed over the Engagement Support Member, to each side of the User Engagement Member 20. These should prove useful in keeping the User Engagement Member 20 in the middle of the apparatus.

As mentioned previously, the force exerted upward upon the user by the seat may be reduced by having the user push downward upon the handle members. Since the seat is moving upward, this produces an exercise routine commonly known as "dips" and will exercise the upper body muscle groups. The user may also pull upward upon the handle members while the seat is moving upward, producing resistance in the upward movement of the seat support member, thus producing resistance to the downward movement of the front part of the leg engagement member. Thus the user is able to utilize their body weight and body strength for motion resistance.

Figure 8A:
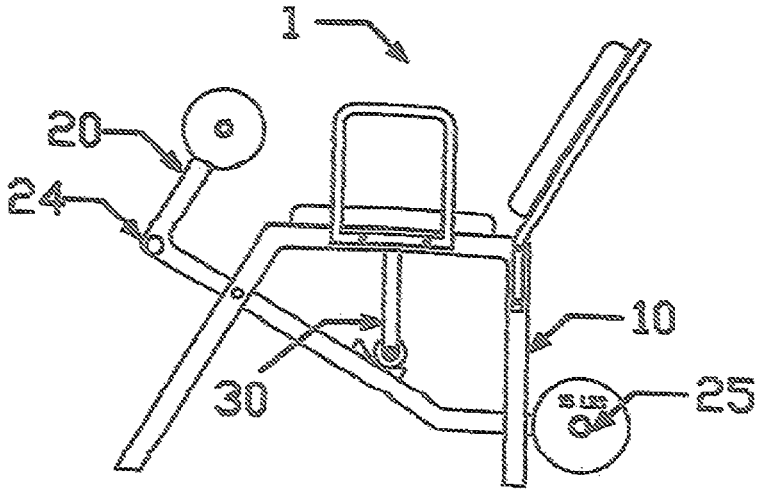
FIG. 8A is a side view of the User Lift Exercise Apparatus demonstrating weights added to the back portion of the User Engagement Member.
Figure 8B:
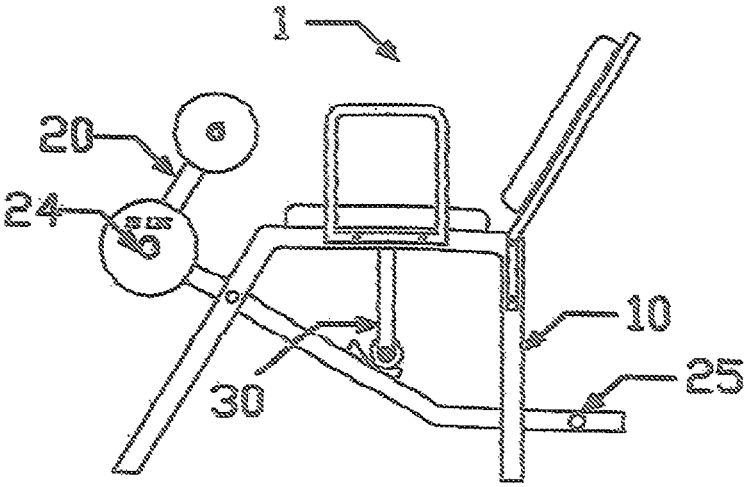
FIG. 8B is a side view of the User Lift Exercise Apparatus demonstrating weights added to the front portion of the User Engagement Member.

FIGS. 8A and 8B demonstrate how weights may be added to the Leg Engagement Member to make movement of the User Engagement Member 20 and Seat Support Member 30 both easier and more difficult. When weights are added to the Front Weight Support Members 24 as shown in FIG. 8B, the front portion of the User Engagement Member is heavier, which makes its movement in the downward direction and the movement of the Seat Support Member in the upward direction easier. When weights are added to the Back Weight Support Members 25 as shown in FIG. 8A, the back portion of the User Engagement Member is heavier, which makes its movement in the upward direction and the movement of the Seat Support Member in the upward direction more difficult. This can also be accomplished by adding a weight support member to the Seat Support Member 30 itself, but it should prove better to utilize the back portion of the User Engagement Member 20. When weights are added to the Front Weight Support Members 24, there may be enough force exerted by the weights to cause the User Engagement Member to pivot, and the Seat Support Member to rise. It may prove useful to have some type of "catch" mechanism to prohibit this from happening until the user is in place on the apparatus and can manually release the "catch" mechanism. Utilizing weights should prove very useful when the user is using the Handle Members 40 to also perform upper body exercise routines.

Figure 9:
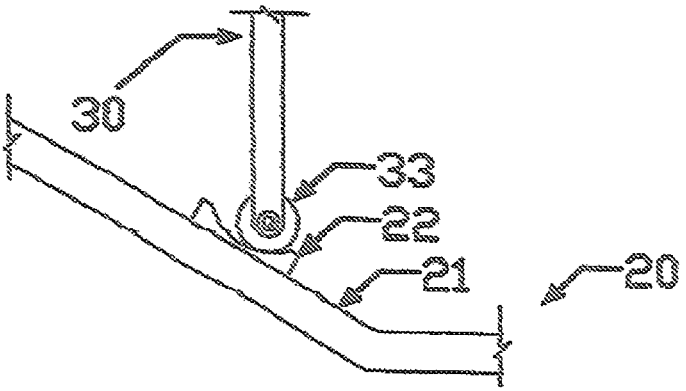
FIG. 9 is a side view demonstrating the manner in which the User Engagement Member and the Seat Support Member of the User Lift Exercise Apparatus are operatively coupled together.

FIG. 9 demonstrates the coupling of the Engagement Coupling Member 22 of the User Engagement Member 20, and the Seat Coupling Member 33 of the Seat Support Member 30. As shown, the Engagement Coupling Member 22 may be a curved structure which mounts to the top side of the back portion of the Main Engagement Support Member 21. The Seat Coupling Member 33 may be a roller element, such as a wheel, which is pivotally mounted to the Seat Guide Member 32 of the Seat Support Member 30. It is positioned such that it is free to roll within the curved portion of the Engagement Coupling Member 22. Since the back part of the Main Engagement Support Member 21 has an upward bend, the radius of curvature of the Engagement Coupling Member 22 may be designed such that the point of contact between the Engagement Coupling Member 22 and the Seat Coupling Member 33 is almost always vertically perpendicular, which allows the force transferred between the two to be mainly in the upward and downward directions. This would make movement of the Seat Support Member much easier and smoother.

Figure 10:
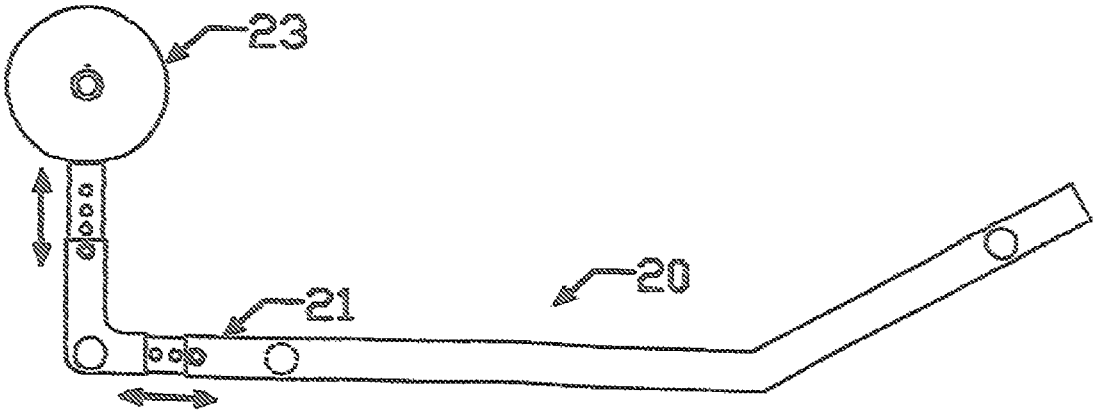
FIG. 10 is a side view of the User Engagement Member of the User Lift Exercise Apparatus demonstrating adjustable features.

FIG. 10 demonstrates adjustment features of the Main Engagement Support Member 21 of the User Engagement Member 20. The User Engagement Member 20 may have an upwardly extending portion which supports the Thigh Engaging Member 23. It may be adjustable in the upward and downward directions. Also, the front portion of the User Engagement Member 20, which is before the pivot point, may be adjustable in the forward and backward directions. Each of these adjustment features allows the apparatus to be configured for different people having different leg lengths. Adjustments may be accomplished using bolt assemblies and structure hole openings, as is commonly found in exercise equipment.

Many variations of the User Lift Exercise Apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A User Lift Exercise Apparatus comprising:

a base frame member comprising a rigid base frame structure; a frame guide member; and an engagement support member;

a seat support member coupled to said frame guide member of said base frame member such that said seat support member moves in generally upward and downward directions;

a first handle member mounted on said rigid base frame structure and positioned [to the] left of said seat support member, and a second handle member mounted on said rigid base frame structure and positioned right of said seat support member a user engagement member having a main engagement support member pivotally coupled to said engagement support member of said base frame member, said main engagement support member having a front portion which extends forward of said engagement support member of said base frame member, and a back portion which extends backward of said engagement support member of said base frame member; a leg engagement member mounted to said front portion of said main engagement support member of said user engagement member; said back portion of said main engagement support member of said user engagement member operatively connected to said seat support member;

whereby a user positions himself/herself in a seated position upon said seat support member and pushes downward upon said leg engagement member of said user engagement member with portions of their legs, and pivots said front portion of said main engagement support member in the downward direction, such that said downward movement of said front portion of said main engagement support member produces movement of said back portion of said main engagement support member in the upward direction, said upward movement of said back portion of said main engagement support member producing upward movement of said seat support member, along a generally linear path, and vice versa, while selectively engaging said handle members with their hands in order to make movement of said seat support member either more easy or more difficult.

2. The User Lift Exercise Apparatus as claimed in claim 1, said rigid base frame structure having a front area, back area, right side area, left side area, top area, and a bottom area, with said frame guide member mounted on said top area of said base frame member and having a guide member opening through which said seat support member is coupled, and with said engagement support member mounted to said front area of said base frame member.

3. The User Lift Exercise Apparatus as claimed in claim 2, said seat support member comprising a generally horizontal main seat member with an elongated seat guide member mounted beneath thereon and extending in a downward direction and having a seat coupling member mounted at its bottom, said seat coupling member being a roller element; said seat guide member coupled to said guide member opening of said frame guide member of said base frame member such that said seat support member moves in a generally upward and downward direction, along a generally linear path of motion.

4. The User Lift Exercise Apparatus as claimed in claim 3, said front portion of said main engagement support member of said user engagement member being mounted to said engagement support member of said base frame member at an angle; said back portion of said main engagement support member of said user engagement member having an upward bend and having an engagement coupling member mounted thereon which is curved in nature and is used to engage said roller element of said seat support member, said roller element rolling along said curved engagement coupling member as said main engagement member of said user engagement pivots along said base frame member; said back portion of said main engagement support member extending beneath said seat support member.

5. The User Lift Apparatus as claimed in claimed 4, said curved engagement coupling member of said user engagement member having a curve design which allows the force transfer between the engagement coupling member and said roller element of said seat support member to be in a generally vertical direction.

6. The User Lift Exercise Apparatus as claimed in claim 2 further comprising a back support member mounted on said top and back areas of said base frame member.

7. The User Lift Exercise Apparatus as claimed in claim 1, said front portion of said main engagement support member of said user engagement member having weight support members mounted thereon.

8. The User Lift Exercise Apparatus as claimed in claim 1, said back portion of said main engagement support member of said user engagement member having weight support members mounted thereon.

9. The User Lift Exercise Apparatus as claimed in claim 1, said front portion of said main engagement support member of said user engagement member further comprising an upwardly extending portion upon which said leg engagement member mounts, said main engagement support member of said user engagement member being adjustable such that said leg engagement component of said user engagement member is selectively repositioned in the generally forward, backward, upward, and downward directions.

10. A User Lift Exercise Apparatus comprising:

a base frame member comprising a rigid base frame structure having a front area, back area, right side area, left side area, top area, and a bottom area; a frame guide member mounted on said top area of said base frame member; and an engagement support member mounted to said front area of said base frame member;

a seat support member coupled to said frame guide member of said base frame member such that said seat support member moves in generally upward and downward directions;

a first handle member mounted on said rigid base frame structure and positioned left of said seat support member, and a second handle member mounted on said rigid base frame structure and positioned right of said seat support member a user engagement member having a main engagement support member pivotally coupled to said engagement support member of said base frame member, said main engagement support member having a front portion which extends forward of said engagement support member of said base frame member, and a back portion which extends backward of said engagement support member of said base frame member; a leg engagement member mounted to said front portion of said main engagement support member of said user engagement member; said back portion of said main engagement support member of said user engagement member operatively connected to said seat support member;

whereby a user positions himself/herself in a seated position upon said seat support member and pushes downward upon said leg engagement member of said user engagement member with portions of their legs, and pivots said front portion of said main engagement support member in the downward direction, such that said downward movement of said front portion of said main engagement support member produces movement of said back portion of said main engagement support member in the upward direction, said upward movement of said back portion of said main engagement support member producing upward movement of said seat support member, along a generally linear path, and vice versa, while selectively engaging said handle members with their hands in order to make movement of said seat support member either more easy or more difficult.

11. The User Lift Exercise Apparatus as claimed in claim 10, said frame guide member of said base frame member having a guide member opening through which said seat support member is coupled.

12. The User Lift Exercise Apparatus as claimed in claim 11, said seat support member comprising a generally horizontal main seat member with an elongated seat guide member mounted beneath thereon and extending in a downward direction and having a seat coupling member mounted at its bottom, said seat coupling member being a roller element; said seat guide member coupled to said guide member opening of said frame guide member of said base frame member such that said seat support member moves in a generally upward and downward direction, along a generally linear path of motion.

13. The User Lift Exercise Apparatus as claimed in claim 12, said front portion of said main engagement support member of said user engagement member being mounted to said engagement support member of said base frame member at an angle; said back portion of said main engagement support member of said user engagement member having an upward bend and having an engagement coupling member mounted thereon which is curved in nature and is used to engage said roller element of said seat support member, said roller element rolling along said curved engagement coupling member as said main engagement member of said user engagement pivots along said base frame member; said back portion of said main engagement support member extending beneath said seat support member.

14. The User Lift Apparatus as claimed in claimed 13, said curved engagement coupling member of said user engagement member having a curve design which allows the force transfer between the engagement coupling member and said roller element of said seat support member to be in a generally vertical direction.

15. The User Lift Exercise Apparatus as claimed in claim 11 further comprising a back support member mounted on said top and back areas of said base frame member.

16. The User Lift Exercise Apparatus as claimed in claim 10, said front portion of said main engagement support member of said user engagement member having weight support members mounted thereon.

17. The User Lift Exercise Apparatus as claimed in claim 10, said back portion of said main engagement support member of said user engagement member having weight support members mounted thereon.

18. The User Lift Exercise Apparatus as claimed in claim 10, said front portion of said main engagement support member of said user engagement member further comprising an upwardly extending portion upon which said leg engagement member mounts, said main engagement support member of said user engagement member being adjustable such that said leg engagement component of said user engagement member is selectively repositioned in the generally forward, backward, upward, and downward directions.

* * * * *